US010695926B2

(12) United States Patent
Rodger

(10) Patent No.: US 10,695,926 B2
(45) Date of Patent: Jun. 30, 2020

(54) APPARATUS AND METHOD FOR CUTTING OUT A VEHICLE GLAZING PANEL

(71) Applicant: BELRON HUNGARY KFT-ZUG BRANCH, Zug (CH)

(72) Inventor: Scott David Rodger, Essex (GB)

(73) Assignee: Belron International Limited, Egham (GB)

( * ) Notice: Subject to any disclaimer, the term of this patent is extended or adjusted under 35 U.S.C. 154(b) by 17 days.

(21) Appl. No.: 15/514,605

(22) PCT Filed: Oct. 12, 2015

(86) PCT No.: PCT/EP2015/073563
§ 371 (c)(1),
(2) Date: Mar. 27, 2017

(87) PCT Pub. No.: WO2016/058989
PCT Pub. Date: Apr. 21, 2016

(65) Prior Publication Data

US 2017/0266830 A1 Sep. 21, 2017

(30) Foreign Application Priority Data

Oct. 14, 2014 (GB) ..... 1418184.6

(51) Int. Cl.
*B26D 1/547* (2006.01)
*B26D 7/26* (2006.01)

(52) U.S. Cl.
CPC ..... *B26D 1/547* (2013.01); *B26D 7/2628* (2013.01)

(58) Field of Classification Search
CPC ..... B26D 1/547; B26D 7/2628
USPC ..... 83/200.1, 651.1, 56; 29/559, 426.4; 254/278
See application file for complete search history.

(56) References Cited

U.S. PATENT DOCUMENTS 7,270,357 B1 * 9/2007 Liao ..... B65G 7/12 294/15
7,618,023 B2 11/2009 Ericson
7,993,121 B1 * 8/2011 Chan ..... B29C 73/025 264/36.21
8,307,873 B2 * 11/2012 Klabunde ..... B26B 7/00 156/717
8,474,355 B2 * 7/2013 Finck ..... B26B 27/002 29/402.03
9,095,988 B2 * 8/2015 Finck ..... B26D 1/547
9,233,478 B2 * 1/2016 Finck ..... B26B 7/00
9,248,992 B2 * 2/2016 Davies ..... B25B 11/007
9,862,563 B2 * 1/2018 Finck ..... B26D 1/547
(Continued)

FOREIGN PATENT DOCUMENTS

DE 29711291 U1 9/1997
FR 2968264 A1 * 6/2012 ..... B25B 11/007
(Continued)

*Primary Examiner* — Ghassem Alie
*Assistant Examiner* — Bharat C Patel
(74) *Attorney, Agent, or Firm* — Gordon & Jacobson, P.C.

(57) ABSTRACT

A winder unit (1) is for use with a cutting filament (such as a wire) in cutting out a vehicle glazing panel. The winder unit has a winder spool (3, 4) for winding cutting filament and a mount (2) for mounting the unit. The winder spool (3, 4) is movable relative to the mount (2) between first and second operational positions for example by means of being pivoted or tilted.

11 Claims, 4 Drawing Sheets

(56) References Cited

U.S. PATENT DOCUMENTS

| | | | | |
|---|---|---|---|---|
| 9,962,847 | B2 * | 5/2018 | Carlton | B26D 1/547 |
| 2007/0000361 | A1 * | 1/2007 | Ericson | B25B 11/007 83/13 |
| 2008/0012349 | A1 * | 1/2008 | Finck | B26B 27/002 292/70 |
| 2012/0222527 | A1 * | 9/2012 | Seebauer | B26D 1/547 83/13 |
| 2017/0100849 | A1 * | 4/2017 | Finck | B26D 5/08 |

FOREIGN PATENT DOCUMENTS

| | | | | |
|---|---|---|---|---|
| GB | 2465847 | A | 6/2010 | |
| IE | 86275 | A1 | 10/2013 | |
| WO | WO 8607017 | A1 * | 12/1986 | B26B 27/002 |
| WO | WO2006/030212 | A1 | 3/2006 | |
| WO | WO2012/069804 | A1 | 5/2012 | |

* cited by examiner

APPARATUS AND METHOD FOR CUTTING OUT A VEHICLE GLAZING PANEL

CROSS-REFERENCE TO RELATED APPLICATIONS

This application is the National Stage of International Patent Application No. PCT/EP2015/073563 filed on Oct. 12, 2015, which claims priority from British Patent Application No. GB 1418184.6 filed on Oct. 14, 2014, both of which are hereby incorporated by reference herein in their entireties.

BACKGROUND

1. Field

The present invention relates to a vehicle glazing panel cut out apparatus and method.

The invention particularly relates to a technique using a cutting line or filament such as a wire or synthetic fibre line in order to effect release of the glazing panel, such as a windscreen, from its mounted position in the vehicle windscreen frame. The technique and cut-out tool of the present invention is also applicable to use on other bonded glazing panels.

2. State of the Art

Prior art is known which uses winder spools for winding the cutting line or wire mounted on a single tool in order to effect cut out of a vehicle windscreen or side glass. Exemplary arrangements are disclosed in, for example U.S. Pat. No. 7,618,023 WO2006030212 WO2012069804.

SUMMARY

An improved technique and apparatus have now been devised.

According to a first aspect, the present invention provides a winder unit for use with a cutting line or filament (such as a wire) in cutting out a vehicle glazing panel, the winder unit having:

at least one winder spool for winding cutting filament;

a mount for mounting the unit;

wherein the winder spool is movable relative to the mount between first and second operational positions.

It is preferred that the winder spool is movable relative to the mount between first and second operational positions, such that the rotational axis of the winder spool is movable (preferably angularly for example by being tilt-able) relative to the mount between first and second positions.

This may be achieved by means of the winder spool being arcuately, hinge, pivot, or tilt, movable relative to the mount between first and second operational positions.

It is preferred that the unit includes at least one filament or line guide spaced from the winder spool, wherein the winder spool and filament or line guide are movable relative to the mount between first and second operational positions.

In certain embodiments it may be preferred that the winder spool and filament guide are mounted to be moveable together (in unison) between first and second operational positions. To this end they may be mounted for movement on a common movable component such as a platform or deck.

In certain embodiments it may be preferred that the unit comprises two winder spools, both being movable relative to the mount between first and second operational positions.

Beneficially, in such an embodiment, the winder spools may be mounted to be moveable together between first and second operational positions.

It is preferred that the unit includes at least one filament or line guide spaced from the one or more spools, which filament or line guide comprises a rotatable guide such as a pulley wheel.

In one embodiment it is preferred that the unit comprises two spaced winder spools and a respective two filament or line guides spaced one at either side of a respective spool, the spools and guides being movable (preferably together) relative to the mount between first and second operational positions.

It is preferred that securing means is provided for securing the winder spool (and also preferably the line guide, where present) in fixed position relative to the mount.

Beneficially, the securing means is arranged to secure the spool relative to the mount in the first and second positions and one or more positions intermediate the first and second positions.

Beneficially, the unit further comprises at least one filament or line guide spaced from the winder spool, wherein the winder spool and filament guide are movable relative to the mount between first and second operational positions and wherein the same securing means secures both the winder spool and filament guide relative to the mount.

In certain embodiments it is preferred that the mount comprises a suction mount.

In an alternative definition, the invention provides winder unit for use with a cutting line or filament (such as a wire) in cutting out a vehicle glazing panel, the winder unit having:

at least one winder spool for winding cutting filament;

at least one filament or line guide spaced from the winder spool;

a mount for mounting the unit;

wherein the winder spool and filament or line guide are mounted to be movable in unison (preferably angularly) relative to the mount between first and second operational positions.

The invention will now be further described, in a specific embodiment, by way of example, and with reference to the accompanying drawings.

DETAILED DESCRIPTION

Figure 1:
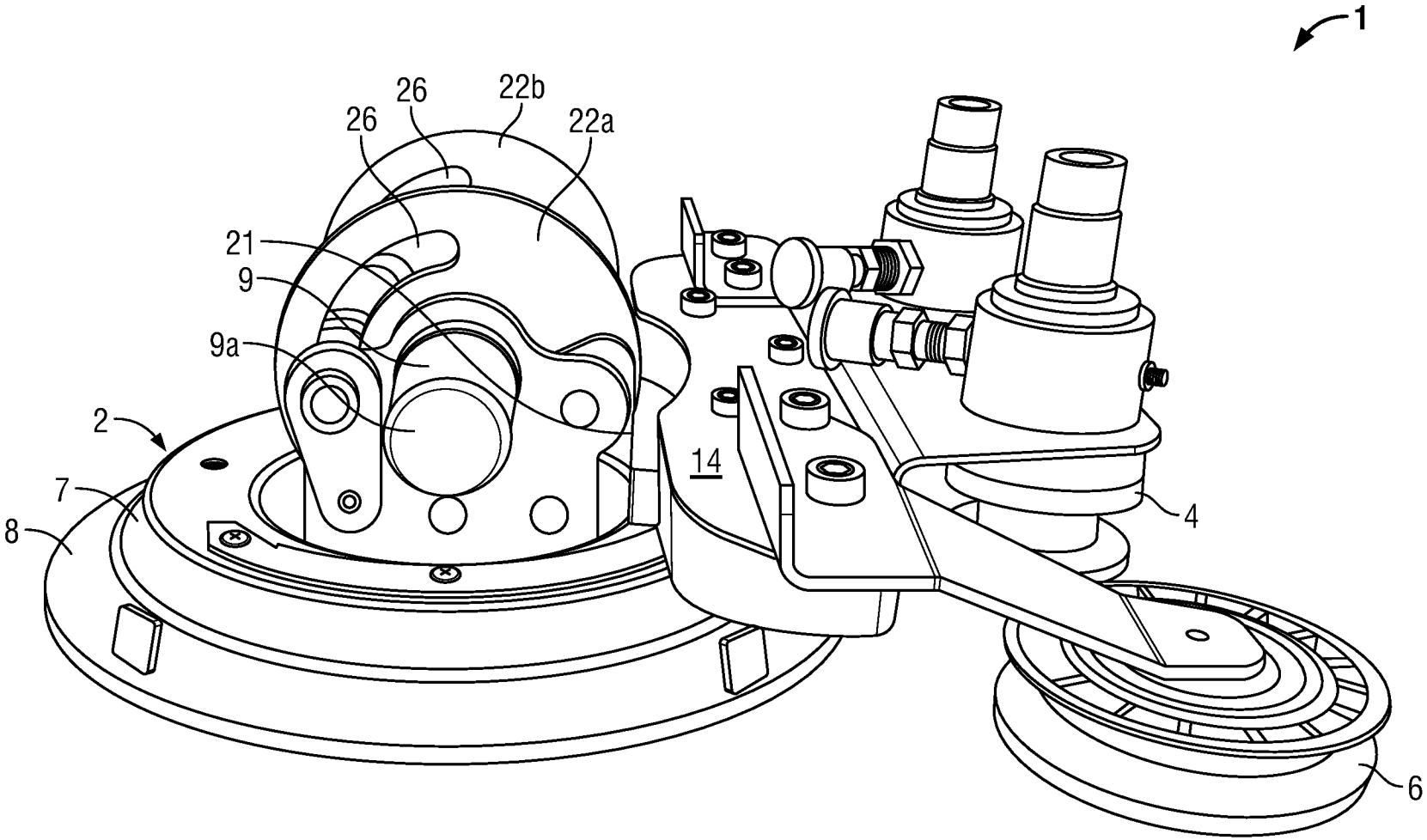
FIG. 1 is a schematic perspective view of apparatus in accordance with the invention in a first position or configuration.
Figure 2:
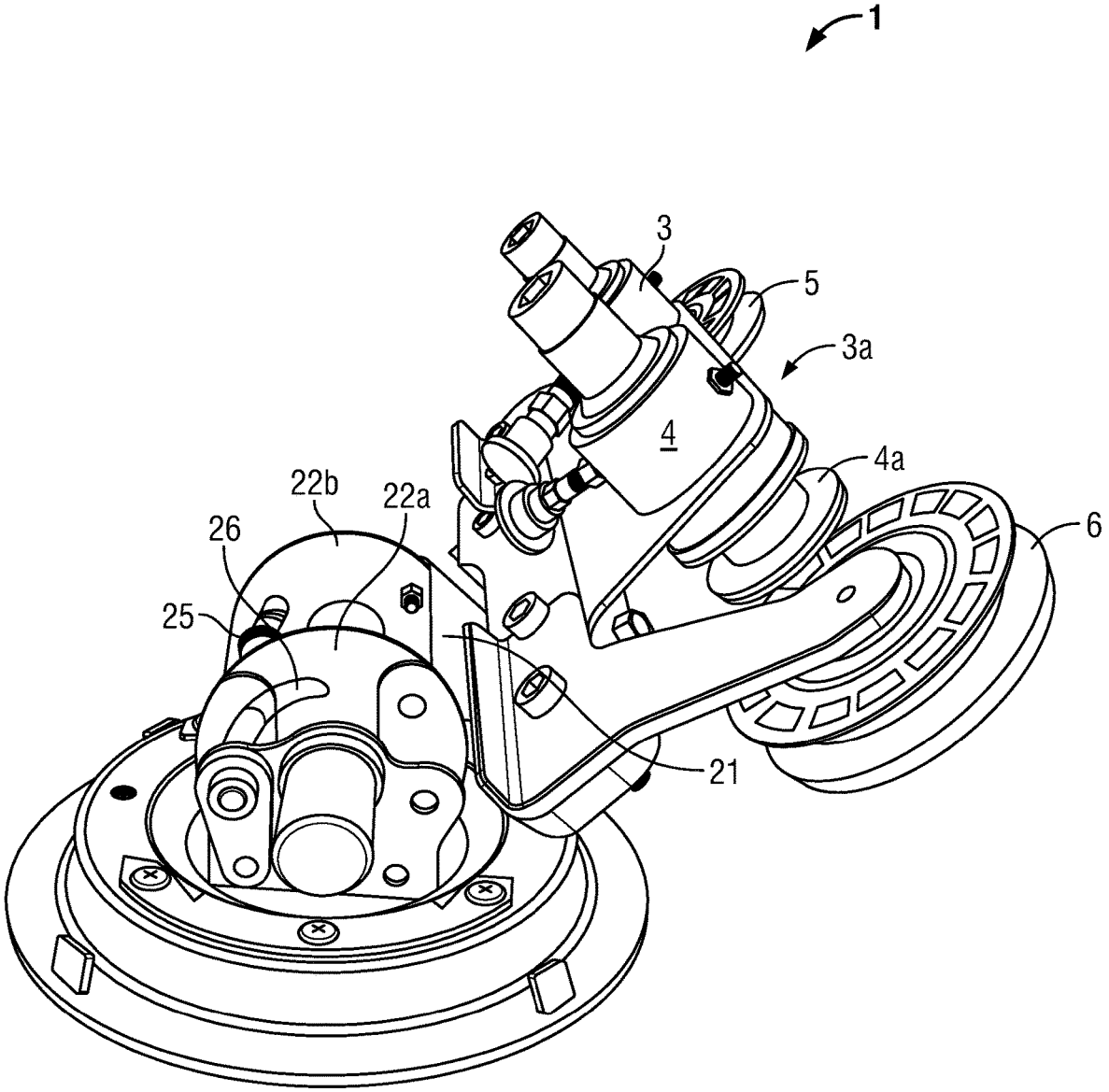
FIG. 2 is a schematic perspective view of the apparatus of FIG. 1 in a second position or configuration.
Figure 3:
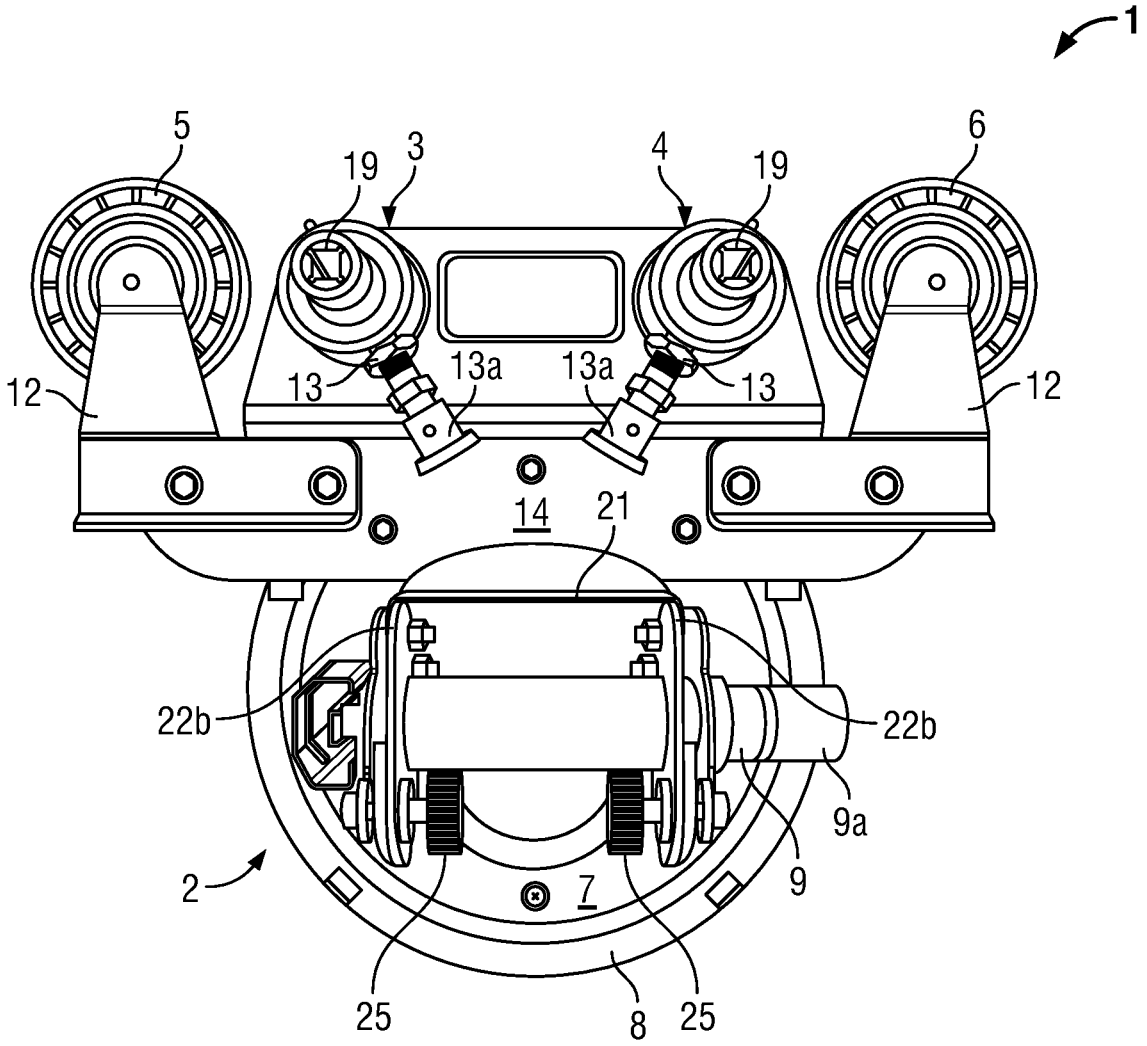
FIG. 3 is a plan view of the apparatus of FIG. 1.

Referring to the drawings, the cut out apparatus comprises a winder unit 1 for use in winding a cutting filament such as a cutting wire or fibre line for use in cutting out a vehicle glazing panel. Techniques for winding cutting filaments are known in the art. The unit 1 as shown has a single suction mount 2 but it will be readily appreciated that plural suction mounts may be utilised. Mounted on-board the suction mount 2 are a pair of spaced winder spools 3, 4 and pair of spaced rotatably mounted guide pulley wheels 5, 6. The suction mount 2 enables the wire winder unit 1 to be releasably and securely mounted to the vehicle windscreen (typically on the inside of the vehicle). The winder spools 3, 4 are spaced to be positioned one on either side of a diameter line of the suction mount.

The suction mount 2 comprises a rigid plastics cup moulding 7 and an underlaying flexible rubber sucker membrane 8. The flexible rubber sucker membrane 8 extends beyond the periphery of the rigid plastics cup moulding 7 in order to enhance the suction capability of the suction mount 2. A manually actuatable suction pump 9 enables consistent suction to be applied and released. Using the pump piston actuator 9*a*.

The winder spools 3, 4 and also the guide pulley wheels 5,6 are provided on board a winder spool mounting deck 14 which is tilt-ably mounted to the to the suction mount 2. The deck 14 carries the pair of winding spools 3, 4 in side by side relationship such that the wire receiving reel 4*a* is underslung below the deck 14. The winder spools 3, 4 are connected to axial winding shafts which are supported in bearings provided on the deck 14. The winder spools 3, 4 are driven axially rotationally either manually via a hand winder or by means of a mechanical actuator such as a motorised winding or winching tool. Drive bosses 19 are provided with female sockets (square bores) for receiving the male driving tool. Positioned outwardly of the winding spools are respective wire guide pulley wheels 5, 6 of low friction plastics material. The pulley wheels are mounted to be rotatable about respective rotational axes. The guide pulleys rotate as the cutting wire is drawn tangentially across the pulleys as will be described. The winder spools 3, 4 are held to rotate in one direction only (each in opposite senses) by respective ratchet mechanisms 13. Each mechanism includes ratchet override permitting prior tightened wire to be slackened, or unwound (reverse wound) the ratchets can be overridden by pulling out the ratchet release knobs 13*a*.

Figure 4A:
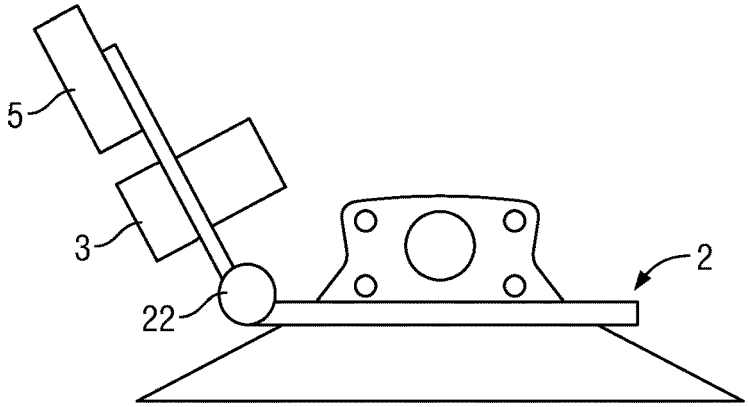
FIGS. 4A and 4B are side views of the apparatus in different configurations.
Figure 4B:
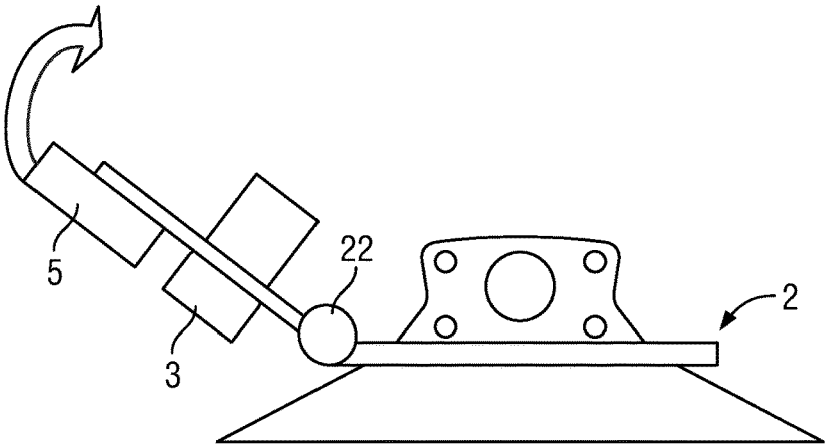

The guide pulley wheels 5, 6 are mounted to the deck 14 by means of pulley wheel mounting arms 12. Because both the guide pulley wheels 5,6 and the winder spools 3, 4 are both mounted to the deck and the deck 14 is tilt-ably/pivotably mounted to the suction mount 2, the spools 3,4 and pulleys 5,6 are movable in unison to tilt upwardly or downwardly relative to the suction mount 2. This enables the position of guide pulley wheels 5, 6 and the spools 3, 4 to be altered dependent upon the degree of curvature of the screen upon which the device is being used. Different degrees of tilting orientation are shown in FIGS. 4A and 4B. Encompassed within the broad ambit of the idea of the pulley wheels 5, 6 and the spools 3, 4 being movable in this fashion is any means by which the spools 3, 4 and the wheels 5, 6 can be re-orientated either in unison or independently from one operational position to another in which the rotational axis of either is changed with respect to the glazing panel to which the unit is mounted. There are however perceived to be benefits in an arrangement in which the spools 3, 4 and pulleys 5, 6 are moveable in unison.

Figure 5:
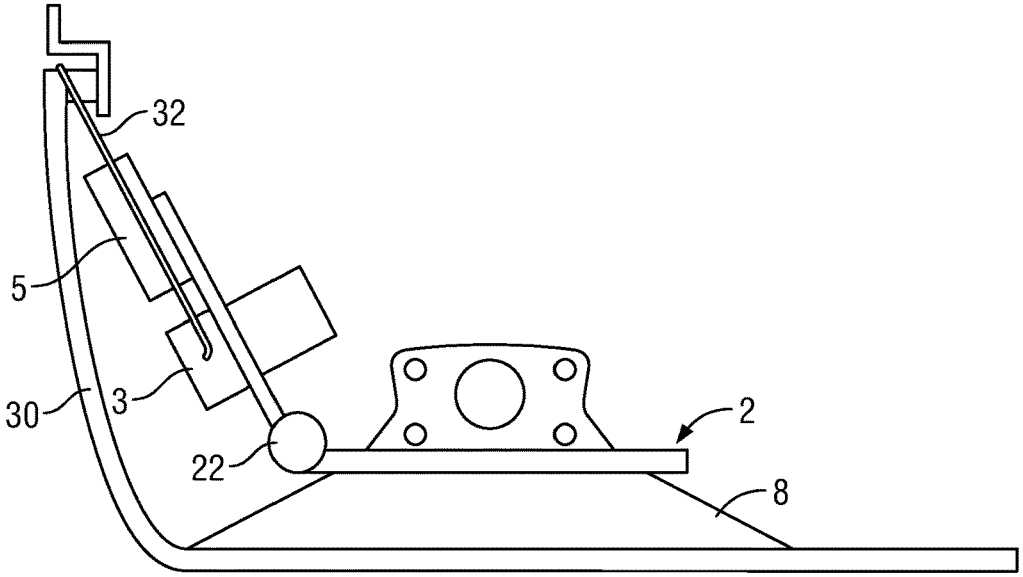
FIG. 5 is a side view showing the apparatus in use.

Importantly means is provided for securing the pulleys 5, 6 and spools in the various angular orientations with respect to the suction mount 2. In the arrangement shown this is achieved by the deck 14 being mounted by means of a bracket 21 to a pair of rotatable wings 22*a* 22*b*. By means of rotating the wings about the axis of the pump 9, the deck 14 (and the spools 3, 4 and pulleys 5, 6 mounted thereto) arcuately move rotatably about an axis defined along the pump 9. The securing means comprises screw clamps 25 which screw against the wings 22*a*, 22*b*. The shaft of the screws 25 passes through a keyway 26 to permit angular tilting or arcuate movement of the deck 14 and securing in position. In any event the precise mechanism of the hinging and the securing means is not essential to the invention, save to the extent that such means are provided. The In the embodiment shown on FIGS. 4 and 5 an alternative hinging mechanism 22 is shown schematically. It is beneficial that the securing mechanism allows the pulleys and spools 3, 4 to be secured in any one of a plurality of desired selected positions.

In use, the arrangement can be used in a generally similar manner to the winder unit described in FIGS. 9 to 1 of WO2006030212. Initially a flexible cutting wire is looped around the outside of a windscreen glazing panel to lie peripherally adjacent the bonding bead (typically a polyurethane bonding bead) which is sandwiched between the glazing panel and the support frame of the vehicle. Opposed ends of the cutting wire are fed through a pierced channel made through the bonding bead and the free ends are then each wound around a separate winder spool of the winder unit.

The glazing panel can as such be removed using a wire and the winder unit 1 only (no additional guide is required).

An important improvement over the prior art is that because both the spools 3,4 and the pulleys can hinge, tilt or otherwise arcuately re-orientate relative to the suction mount 2, glazing panels of higher degree of curvature such as for example found on coaches or busses can be accommodated for removal using cutting filament techniques. This is shown schematically in FIG. 5. The design allows the cutting line or filament 32 to be pulled in the correct direction whilst the suction mount 2 is fitted to a spaced portion of the very curved glazing panel 30.

The invention claimed is:

1. A winder unit for use with a cutting filament in cutting out a vehicle glazing panel, the winder unit comprising:

a mount for mounting the winder unit;

at least one winder spool for winding cutting filament, wherein the winder spool is movable relative to the mount between a first operational position and a second operational position, wherein the winder spool has a rotational axis, and wherein the winder spool is arcuately movable such that the rotational axis of the winder spool is tiltable relative to the mount between the first and second operational positions;

securing means for securing the winder spool relative to the mount in the first and second operational positions; and at least one filament guide is mounted to be fixed in spaced relation to the winder spool, wherein the at least one filament guide comprises a rotatable pulley wheel and wherein the winder spool and the filament guide are mounted to be moveable together between the first and second operational positions.

2. The winder unit according to claim 1, wherein:

the winder unit comprises two winder spools, both being movable relative to the mount between the first and second operational positions.

3. The winder unit according to claim 2, wherein:

the two winder spools are mounted to be moveable together between the first and second operational positions.

4. The winder unit according to claim 1, wherein:

the winder unit comprises two spaced winder spools and two filament guide elements spaced from one another on opposite sides of the two winder spools, the two winder spools and two filament guide elements being movable together relative to the mount between the first and second operational positions.

5. The winder unit according to claim 1, wherein:

the securing means is arranged to secure the winder spool relative to the mount in the first and second operational positions and in at least one further operational position intermediate the first and second operational positions.

6. The winder unit according to claim 1, wherein the securing means secures both the winder spool and the at least one filament guide together relative to the mount.

7. The winder unit according to claim 1, wherein:

the mount comprises a suction mount.

8. A method of removing a vehicle glazing panel using a winder unit according to claim 1.

9. The winder unit according to claim 1, wherein:

the winder includes a plurality of filament guides, and wherein each filament guide of the plurality of filament guides is moveable in unison with the winder spool relative to the mount.

10. A winder unit for use with a cutting filament in cutting out a vehicle glazing panel, the winder unit comprising:

a mount for mounting the winder unit;

at least one winder spool for winding cutting filament, wherein the winder spool is movable relative to the mount between a first operational position and a second operational position, wherein the winder spool has a rotational axis, and wherein the winder spool is arcuately movable such that the rotational axis of the winder spool is tiltable relative to the mount between the first and second operational positions;

at least one filament guide mounted to be fixed in spaced relation to the winder spool, wherein the at least one filament guide comprises a rotatable pulley wheel; and securing means for securing the winder spool relative to the mount in the first and second operational positions, wherein the winder spool and the at least one filament guide are mounted to be movable in unison relative to the mount between first and second operational positions.

11. The winder unit according to claim 10, wherein:

the winder includes a plurality of filament guides, and wherein each filament guide of the plurality of filament guides is moveable in unison with the winder spool relative to the mount.

* * * * *